US009194224B2

(12) United States Patent
Muona

(10) Patent No.: US 9,194,224 B2
(45) **Date of Patent: *Nov. 24, 2015**

(54) METHOD AND ARRANGEMENT FOR DESIGNING DRILLING PLAN

(75) Inventor: Jouko Muona, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 69 days.

This patent is subject to a terminal disclaimer.

(21) Appl. No.: 14/125,982

(22) PCT Filed: Jun. 14, 2012

(86) PCT No.: PCT/FI2012/050605

§ 371 (c)(1),
(2), (4) Date: Dec. 18, 2013

(87) PCT Pub. No.: WO2012/172180

PCT Pub. Date: Dec. 20, 2012

(65) Prior Publication Data

US 2014/0139007 A1 May 22, 2014

(30) Foreign Application Priority Data

Jun. 14, 2011 (FI) ..... 20115588

(51) Int. Cl.
*E21B 44/02* (2006.01)
*E21D 9/00* (2006.01)

(52) U.S. Cl.
CPC ..... *E21B 44/02* (2013.01); *E21D 9/006* (2013.01)

(58) Field of Classification Search
None
See application file for complete search history.

(56) References Cited

U.S. PATENT DOCUMENTS

| | | | | |
|---|---|---|---|---|
| 2002/0036102 | A1* | 3/2002 | Ahtola et al. | 175/57 |
| 2010/0044107 | A1 | 2/2010 | Keskinen | |
| 2010/0286965 | A1* | 11/2010 | Saleniemi et al. | 703/1 |
| 2014/0137759 | A1* | 5/2014 | Muona | 102/312 |

FOREIGN PATENT DOCUMENTS

| | | | |
|---|---|---|---|
| EP | 0760419 | A2 | 3/1997 |
| JP | S55024237 | A | 2/1980 |
| JP | H11-324560 | | 11/1999 |
| JP | 2002503301 | A | 1/2002 |
| JP | 2010513757 | A | 4/2010 |
| JP | 2010513758 | A | 4/2010 |

(Continued)

OTHER PUBLICATIONS

Mancini et al. "Technical and Economic Aspects of Tunnel Blasting Accuracy Control"; Tunnelling and Underground Space Technology vol. 11, No. 4 pp. 455-463, 1996.*

(Continued)

*Primary Examiner* — Sean Shechtman
*Assistant Examiner* — Steven R. Garland
(74) *Attorney, Agent, or Firm* — Corinne R. Gorski

(57) ABSTRACT

A method for designing a drilling plan for rock cavern excavation, which defines in advance for a round to be drilled in a tunnel face at least the locations of drill holes in a predetermined coordinate system, uses the drilling plan created by means of a computer-assisted design program. The method determines pull-out of a round on the basis of the locations of the hole ends and the topography of the rock remaining after a round blast, and designs or modifies the drilling plan for a subsequent round on the basis of the thus determined pull-out.

20 Claims, 3 Drawing Sheets

(56) References Cited

FOREIGN PATENT DOCUMENTS

| | | | |
|---|---|---|---|
| JP | 2010539363 | A | 12/2010 |
| WO | 9857034 | A1 | 12/1998 |
| WO | 03025341 | A1 | 3/2003 |
| WO | 2004085968 | A1 | 10/2004 |
| WO | 2008078001 | A1 | 7/2008 |
| WO | 2008078002 | A1 | 7/2008 |
| WO | 2008125735 | A1 | 10/2008 |
| WO | 2009037381 | A1 | 3/2009 |

OTHER PUBLICATIONS

Sandvik Mining and Construction, "iSURE, a revolution in precision", Julkaisuaika Dec. 30, 2010, Haettu internetosoitteesta, 5 pages.

Sandvik Mining and Construction, "iSURE" [online-tiedote]. Julkaisuaika Dec. 30, 2010 Haettu internetista, 2 pages.

* cited by examiner

METHOD AND ARRANGEMENT FOR DESIGNING DRILLING PLAN

RELATED APPLICATION DATA

This application is a §371 National Stage Application of PCT International Application No. PCT/FI2012/050605 filed Jun. 14, 2012 claiming priority of FI Application No. 20115588, filed Jun. 14, 2011.

BACKGROUND OF THE INVENTION

The invention relates to a method for designing a drilling plan for rock cavern excavation, the drilling plan defining in advance for a round to be drilled in a tunnel face at least the locations of drill holes in a predetermined coordinate system, and the method creating the drilling plan by means of a computer-assisted design program. The invention further relates to an arrangement for designing a drilling plan for excavating a rock cavern with a rock drilling apparatus comprising one or more drilling booms having a rock drilling unit attached to it and a control unit for controlling drilling, which arrangement comprises a computer for designing or modifying the drilling plan, whereby in the drilling plan at least locations of drill holes in a predetermined coordinate system has been defined in advance for a round to be drilled.

Tunnels, underground storage silos and other rock facilities are excavated in rounds. In a tunnel face, drill holes are drilled which are charged and blasted after drilling. One blast detaches from the rock an amount of rock material that equals that of one round. For excavating a rock cavern, a plan is made in advance and information is determined about the rock type, inter alia. In general, the orderer of the rock cavern also sets various quality requirements for the cavern to be excavated.

When face drilling is performed by a rock drilling apparatus provided with instrumentation, there is generally designed, as office work, a drilling plan for drilling a round, in which process attention is also paid to a charging plan provided for blasting the round. This drilling plan is supplied to the rock drilling apparatus for being used by means of its control computer. The drilling plan serves as a controlled instruction for drilling drill holes in the rock in such a manner that a desired round can be formed.

The successfulness of the drilling plan, drilling and charging is measured, inter alia, by pull-out per round, which refers to the ratio of an advance of the tunnel after the blast to the designed length in the drilling plan. To improve the pull-out from 88 to 95 percent, for instance, means significant cost savings in an excavation project. In practice, optimal pull-out is to be found out by changing the drilling plan, the parameters here including positioning, orientation and number of drill holes, blast cut, specific charge in different plan zones.

For designing a drilling plan there are developed design programs that assist the designer in composing the drilling plan. Designing a drilling plan is thus interactive action between the designer and the design program.

Production of drilling plans and continuous design, as well as review of plans during tunnel work, have been developed in various ways, for instance, in view of blasting techniques. Prior art is represented, for instance, by publication WO 2008/078001.

In practice, in round blasting it has been found that even though the hole locations and the size and amount of blasting charges are designed on the basis of the known facts as well as possible, the outcome of the blast does not, however, meet the planned design. Typically, when detached material is removed after the blast, it may be found that the remaining rock surface deviates significantly from the theoretical surface that should have been obtained after the blast. This may result from a plurality of different factors, such as fracturing properties or hardness of rock, or some other factor that cannot have been known in advance with a sufficient accuracy. As a consequence, however, the efficiency of excavation deteriorates and this, in turn, causes quite significant additional costs.

BRIEF DESCRIPTION OF THE INVENTION

The object of the present invention is to provide a method and an arrangement for producing drilling plans that take the conditions better into account than before, and consequently, a tunnel may be excavated more efficiently and more accurately than previously. The method of the invention is characterized by determining, in connection with hole drilling, the location of an end for at least some of the holes; storing the determined locations of hole ends in a memory; determining pull-out of a round on the basis of the locations of the determined hole ends and the topography of rock remaining after a round blast and designing or modifying the drilling plan of a subsequent round on the basis of the thus determined pull-out.

The arrangement of the invention is characterized in that the arrangement comprises means for locating the location of the ends for at least some of the holes, means for storing the determined locations of the hole ends in a memory and means for determining the topography of the rock remaining after the round blast and whereby the pull out of the blasted round can be defined on the basis of the defined end location of the drill holes and the topography of the rock remaining after a round blast and the drilling plan may be designed or modified on the basis of the thus defined pull-out.

The idea of the invention is that in designing a drilling plan for one or more subsequent rounds there are considered the differences between the locations of drill hole ends of a last-blasted round and the locations of starting points of new holes to be drilled. Further, the idea is that changes are made on the basis of these differences.

The invention has an advantage that by taking into account the deviations from the plan appearing in the last-blasted round after blasting it is possible to achieve a more appropriate and more efficient drilling plan for subsequent rounds, which will subsequently increase the pull-out of the round and thus increases the efficiency of the entire tunnelling process and reduces costs. So, changes in rock properties may be taken into account better than before in the whole operation.

BRIEF DESCRIPTION OF THE FIGURES

Some embodiments of the invention will be explained in greater detail in the attached drawings, in which.

In the figures, some embodiments of the invention are shown simplified for the sake of clarity. Like reference numerals refer to like parts in the figures.

DETAILED DESCRIPTION OF SOME EMBODIMENTS

Figure 1:
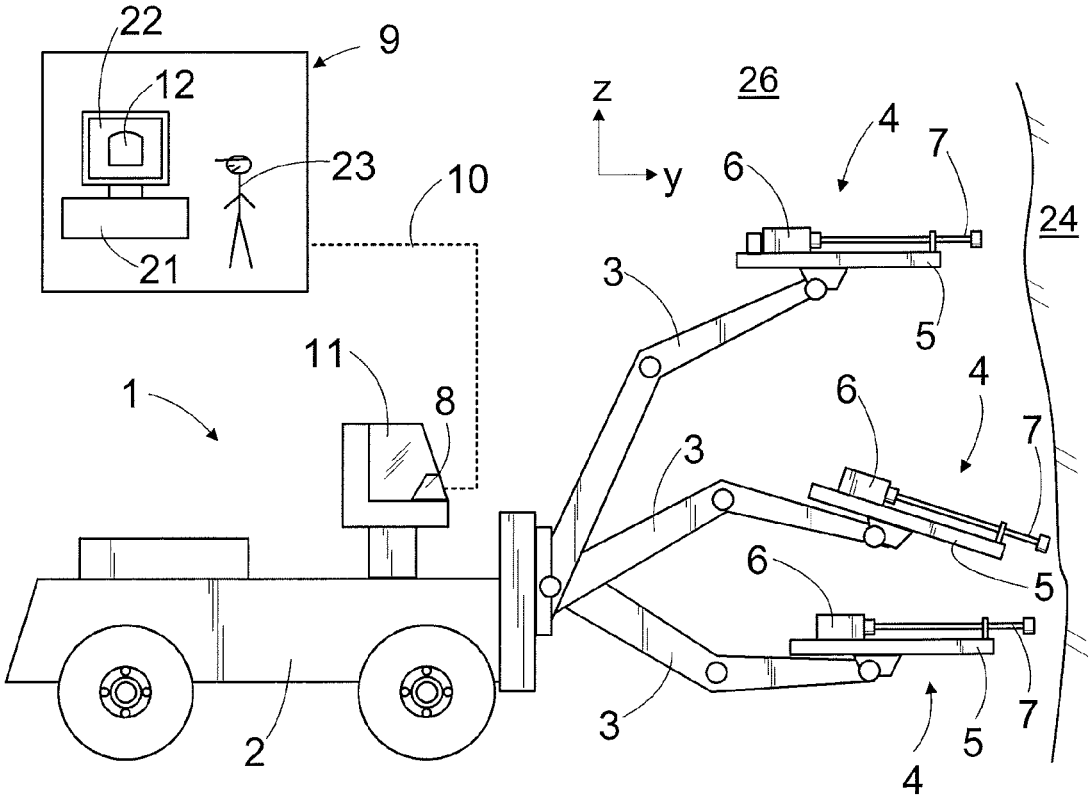
FIG. 1 shows schematically a rock drilling apparatus, in side view, and means, typically separate from the rock drilling apparatus, for designing a drilling plan.

FIG. 1 shows a rock drilling apparatus 1 that comprises a movable carriage 2, one or more drilling booms 3 as well as drilling units 4 arranged on the drilling booms 3. The drilling unit 4 comprises a feed beam 5, on which a rock drilling machine 6 may be moved by means of a feed device. Further, the drilling unit 4 includes a tool 7, by which impact pulses delivered by the rock drilling machine are transmitted to the rock to be drilled. The rock drilling apparatus 1 further comprises at least one control unit 8 configured to control actuators included in the rock drilling apparatus 1. The control unit 8 may be a computer or a corresponding device, and it may comprise a user interface including a display device as well as control means for giving commands and information to the control unit 8.

Typically, a charging plan is created for the drilling of each round in view of the drilling plan. In the drilling plan, the locations of the holes to be drilled are defined in a predetermined coordinate system. The locations of the holes to be drilled may be determined either as the starting points, directions and lengths thereof in said coordinate system, or merely as starting and ending points, on the basis of which the length and the direction are determined in the coordinate system respectively. The charging plan, in turn, defines hole-specifically the explosive to be used, size of a charge, timings for blasting the charges, etc.

The drilling plan is normally designed at premises outside the drilling site, such as an office 9, with a design computer 21, on the display 22 of which the drilling plan 12 is shown, for instance, when created or viewed. From the design computer 21 the drilling plan may be downloaded and stored in a memory means, such as a memory stick or diskette, or it may be transmitted directly over a data transmission connection 10 to a control unit 8 of the rock drilling apparatus and stored in a memory means typically existing in the control unit, such as a hard disk or memory diskette. If so needed, the designing and modifying of the drilling plan 12 may also take place by means of the control unit 8 in a cabin 11 of the rock drilling apparatus 1, for instance. Further, the existing drilling plans may be modified either on the drilling site or outside it. The designing of the drilling plan is computed-aided and generally iterative in nature. A design program is run on the design computer 21, the computer of the control unit 8 or the like, and the designer 23 operates interactively with the design program and enters necessary data, makes selections as well as controls the design process. The already designed parts of the plan may further be iteratively modified during the design process in order to achieve a better outcome.

The drilling plan being completed, it may be downloaded to the control unit 8 of the rock drilling apparatus and executed. The designed drill holes are drilled into the rock 24, they are charged and then blasted. A quantity of rock equal to that of a desired round is broken off the rock 24, which is removed by transportation. Thereafter, new holes are drilled for the next round, in accordance with the same or a new drilling plan 12.

Figure 2:
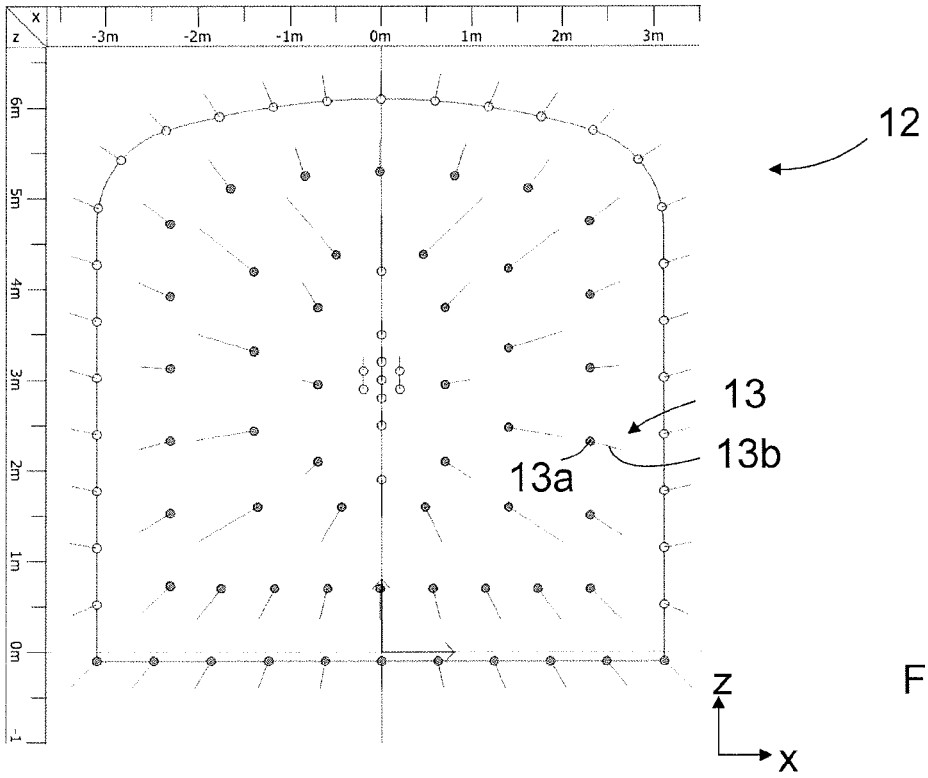
FIG. 2 shows schematically a drilling plan, seen in the direction of a tunnel to be excavated.

FIG. 2 shows an example of a drilling plan 12 which may comprise a plurality of drill holes. In the drilling plan 12, the starting point 13*a* of a drill hole 13 may be represented as a suitable symbol, such as a circle, and the direction of the drill hole as a projection line 13*b* departing therefrom. An xz projection of the drilling plan 12, as shown in FIG. 2, may be displayed in a graphic user interface, i.e. display 22, of the design computer 21, or otherwise in the same manner as in the graphic user interface in the control unit 8 of the rock drilling apparatus 1.

Figure 3:
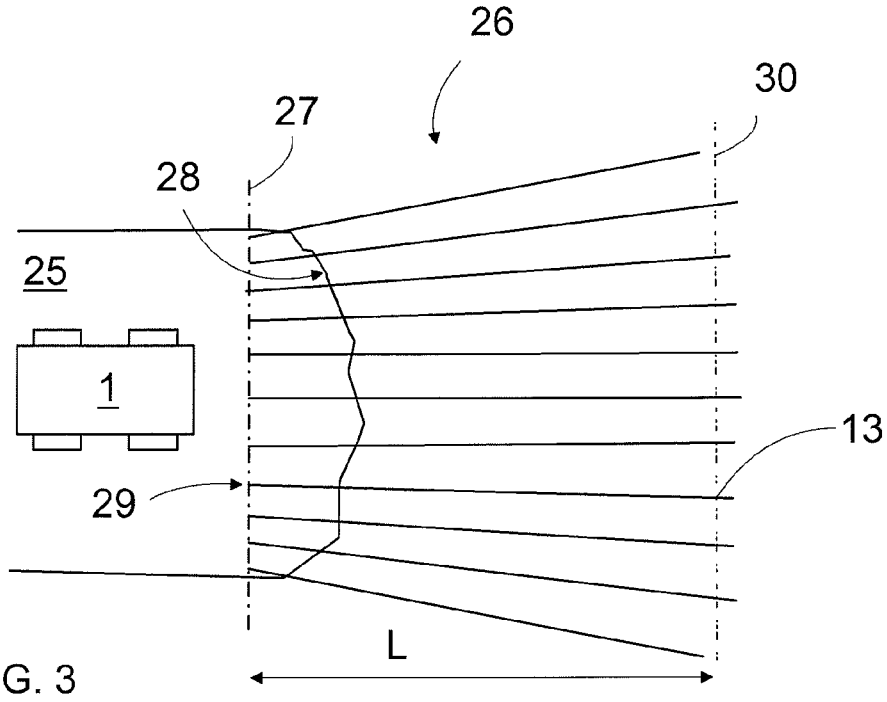
FIG. 3 is a schematic top view of a drilling plan in principle.

FIG. 3 shows the principle of a drilling plan 12, seen from above, in connection with a round 26 to be drilled in a tunnel 25. In navigation, the coordinate systems of the drilling device and the drilling plan are linked to one another and to the coordinate system of the tunnel. After navigation, the drilling of the round may be carried out according to plan.

The figure shows how the holes 13 are located with respect to the rock to be drilled transversally to the tunnel at appropriate intervals and in different directions from the viewpoint of excavation. In general, the basis used for the drilling plan is a so-called navigation plane 27, which is an imaginary plane in the transversal direction of the tunnel at a distance from the actual rock surface 28. In the drilling plan, the theoretical starting points 29 of the holes to be drilled are determined in the coordinate system to be on the navigation plane, and the orientation of booms in the rock drilling apparatus is performed in such a manner that a drill rod passes through that point when the drilling starts.

The nominal length of the round 26 is the distance L between the navigation plane 27 and a theoretical ending plane 30. In reality, as appears in the figure, some of the holes extend beyond the ending plane and some, typically those in the edge parts, remain shorter than the length of the round.

Figure 4A:
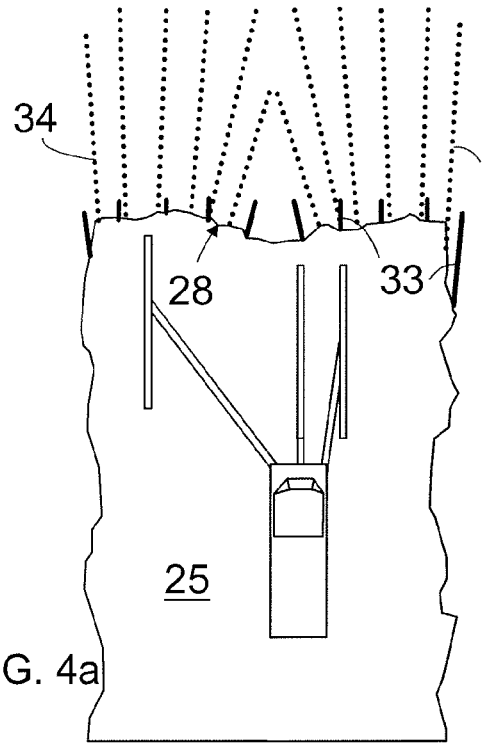
FIGS. 4*a* and 4*b* are schematic top views of an actual situation in a round after blasting.
Figure 4B:
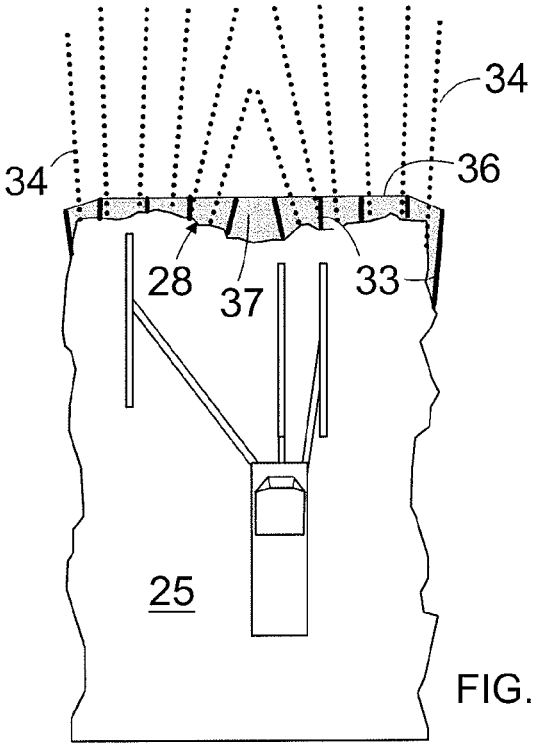

FIGS. 4*a* and 4*b* show schematically the actual situation in the round, seen from above, normally after blasting. In FIG. 4*a*, unbroken lines 33 depict the end parts of the drill holes in the blasted round which remained in the rock after blasting and around which the rock did not detach in the blasting. Further, broken lines 34 depict the holes to be drilled for a next round. The area between the remaining rock surface, i.e. starting surface 28, and the theoretical ending surface 36 passing through the hole ends of the round is rock that, in theory, should have been detached in the blast. This rock is illustrated in FIG. 4*b* by area 37. In practice, such rock always remains, and when the quantity thereof is subtracted from the designed rock quantity intended to detach in the blast, there will be obtained the earlier mentioned pullout, i.e. the detached rock quantity as a percentage of the intended quantity. The remaining rock may vary greatly in thickness in various parts of the transversal surface of the tunnel, depending, inter alia, on the rock type and structure, how well the drilling of holes succeeded, etc.

FIGS. 5*a* to 5*d*, in turn, show schematically, in perspective view, the mutual relation between two actually realized rounds in the same tunnel excavation, and the remaining rock, not detached in connection with the blast, between the designed round and the realized round. The shape of said non-detached rock is obtained, for instance, by determining the locations of the starting points of holes to be drilled in a next round on the surface of the remaining rock and the locations of hole ends of the preceding round and by forming on the basis of these points a body that shows to the user the volume of rock not detached in the round blast.

Figure 5A:
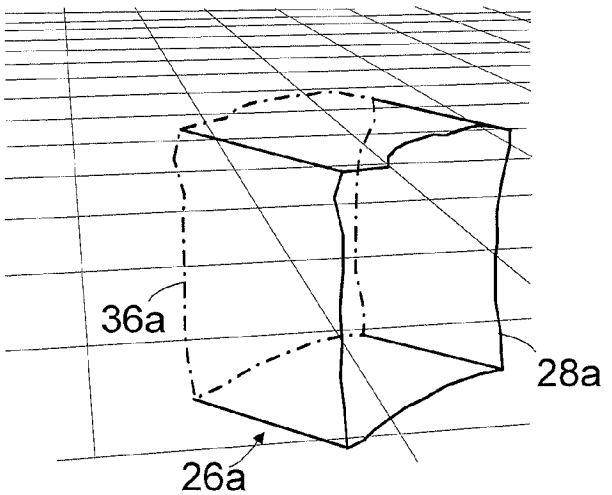
FIGS. 5*a* to 5*d* are schematic perspective views of situations in two consecutive rounds.
Figure 5B:
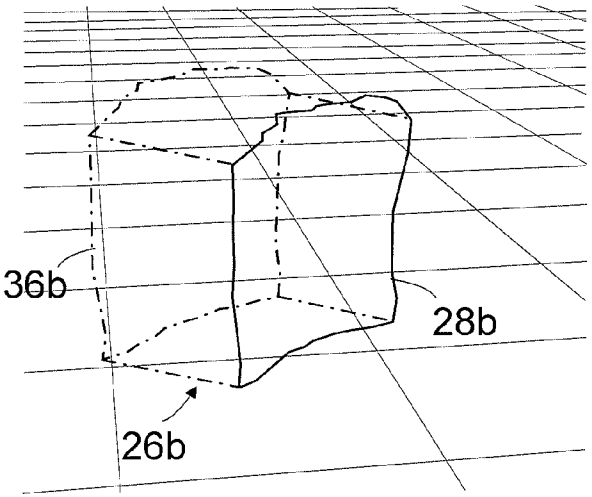

FIG. 5*a* shows the shape of one round 26*a* in the coordinate system of the tunnel on the basis of the starting points of its drilled holes on the starting surface 28*a* of the rock and the ending surface 36*a* defined by the locations of the hole ends and passing therethrough. FIG. 5*b*, in turn, shows in the same coordinate system the shape of a next round 26*b*, correspondingly on the basis of the starting points of new drill holes on the starting surface 28*b* of the rock remaining from the blast of the preceding round 26*a* and the ending surface 36*b* defined by the locations of its hole ends and passing therethrough.

Figure 5C:
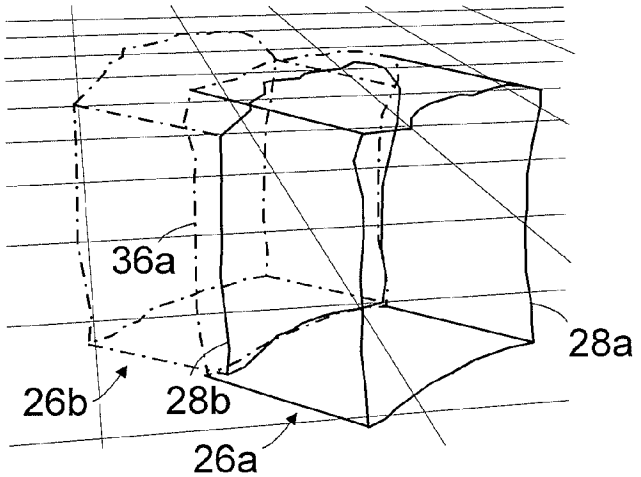
Figure 5D:
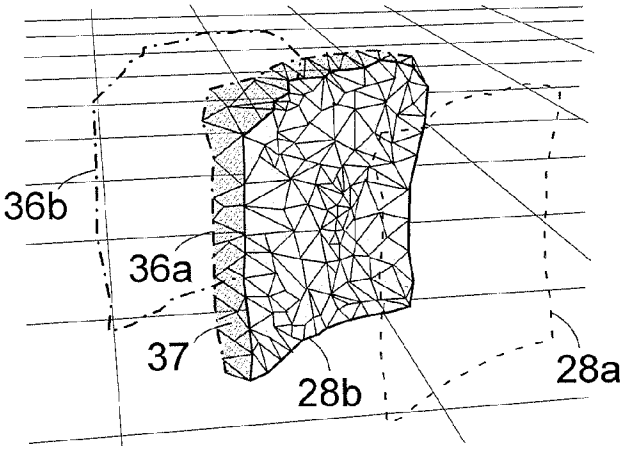

In FIG. 5*c*, the rounds 26*a* and 26*b* are placed in their actual mutual position, and consequently it appears that the starting surface 28*b* of the latter round 26*b* is closer to the starting surface 28*a* of the preceding round 26*a* than the theoretical ending surface 36*a* of the round 26*a*. Hence, between the surfaces 28*b* and 36*a* there remains rock 37 that, in theory, should have been detached in the blast. This rock 37 is illustrated in FIG. 5*d*. This means a loss in the achieved round length, because all the desired rock did not detach. This also means slower advance in the tunneling work as well as additional costs. These features are to be substantially improved by means of this invention.

The idea of this invention is to amend the drilling plan for subsequent rounds in such a manner that on the basis of the blast outcome of the implemented round the drilling plan to be used for drilling one or more subsequent rounds will be modified and optimized.

In current practice, the drill holes are drilled according to the designed plans, irrespective of the location where the actual staring point of the hole is. So, as a consequence of the extra rock the actual starting point of the hole deviates from the theoretical starting point without it having any effect on the design and implementation of the drilling plan. According to this invention, the drilling plan is corrected, if needed, on the basis of the realized outcome. So, for instance, the length of the drill holes and/or the position of their end points may be modified already in connection with a next round, in order that the blast outcome would better correspond to what is desired.

The surface topography of rock determined at the start of hole drilling for a new round and the locations of the drill hole ends in the rock of the blasted round constitute the basis for the modification of the drilling plan. The surface topography of rock, i.e. its profile is obtained by measuring it accurately with a measuring device, such as a laser or ultrasound measuring device. Alternatively, it may be determined approximately, with a sufficient accuracy, by determining the starting points of the drill holes for the next round on the surface of the rock. The determination may be performed either by measuring them with a separate measuring device known per se or by determining the location data by means of the control unit of the rock drilling apparatus. The location data of the starting points of the holes may be measured either before, during or after drilling. Correspondingly, the location data of the drill hole ends are provided either by measuring them with a separate measuring device or by determining them by means of the control unit of the rock drilling apparatus. According to desired accuracy, it is possible to determine the location data of the starting and ending points of all holes or just the location data of suitably selected holes.

By means of the thus determined surface topography of the rock and the location data of the determined hole ends it is possible to calculate the pull-out of the preceding round and, if so needed, to amend the drilling plan for a next round or any subsequent round in the above-described manner.

When the control unit of the rock drilling apparatus is in use, the determination is implemented, in practice, in such a way that when the operator, such as driller, starts drilling a hole, he moves a boom of the rock drilling apparatus to a correct drilling position with respect to the hole to be drilled, whereby the device sensors can measure the starting point of hole in the drilling direction. This information is stored in the control unit of the drilling apparatus, and on the basis of this information and the actual location data of a corresponding, earlier drilled hole is calculated the difference between these points. When this procedure is carried out for all holes or the selected holes in the drilling plan, it is also possible to calculate how much rock, and the amount of rock at each particular point of the transversal surface of the tunnel that remains undetached as compared to the drilling plan.

This principle, either by means of the computer on the drilling apparatus or by transmitting data to a computer outside the rock drilling apparatus for the use of the drilling plan designer not on site, allows the necessary modifications to be determined in the drilling plan for a next round, so that in the next round blast rock material could be broken and detached from the rock in better compliance with the plan. The drilling plan having been defined on the basis of said differential data, it is immediately available to the control computer of the rock drilling apparatus, or it is transmitted to the control computer of the rock drilling apparatus for use.

A change in the drilling plan may be implemented immediately in connection with drilling a round following the blast of a previous round, yet, in practice, it is also useful when employed for correcting the drilling plan of a round subsequent to the next round. In practice, measuring, separate from the drilling device, could be performed by a laser scanner, which stores the surface profile throughout the entire surface and does not concentrate in any way on the starting points of the holes to be drilled. Laser scanning as such is an operation taking only minutes, and therefore it does not slow down the work in any way whatsoever.

In some cases, the features disclosed in this application may be used as such, irrespective of other features. On the other hand, when necessary, the features disclosed in this application may be combined to provide different combinations.

The drawings and the related description are only intended to illustrate the idea of the invention. The details of the invention may vary within the scope of the claims.

The invention claimed is:

1. A method for designing a drilling plan for excavating a rock cavern, the drilling plan defining in advance for a round to be drilled in a tunnel face at least the locations of drill holes in a predetermined coordinate system, and the method creating the drilling plan by a computer-assisted design program, the method comprising the steps of:

determining, in connection with hole drilling, a location of an end for at least some of the holes;

storing the determined locations of the hole ends in a memory;

determining pull-out of a round on the basis of the locations of the determined hole ends and the topography of rock remaining after a round blast; and designing or modifying the drilling plan of a subsequent round on the basis of the determined pull-out.

2. The method of claim 1, wherein the topography of the rock is determined by measuring the profile of the remaining rock with a measuring device.

3. The method of claim 1, wherein the topography of the rock is determined by measuring at least some starting points of the drill holes for a next round on a surface of the rock and by calculating an approximate value of a profile on the basis thereof.

4. The method of claim 3, wherein the locations of the starting points of the holes to be drilled are determined by measuring with a control system of the rock drilling apparatus.

5. The method of claim 3, wherein the locations of the starting points of the holes to be drilled are determined by measuring with a separate measuring device.

6. The method of claim 1, wherein the locations of the ending points of the holes to be drilled are determined by measuring with a control system of the rock drilling apparatus.

7. The method of claim 1, wherein the locations of the ends of the holes to be drilled are determined by measuring with a separate measuring device after the drilling of the hole.

8. The method of claim 1, wherein the drilling plan for the round is designed by a computer included in a control unit of a rock drilling apparatus.

9. The method of claim 1, further comprising the steps of:

transferring measured location data on the drill hole ends from a rock drilling apparatus to an external computer separate from the rock drilling apparatus;

calculating realized pull-out and designing or modifying the drilling plan for a subsequent round by said external computer separate from the rock drilling apparatus; and transmitting a obtained drilling plan to the control computer of the rock drilling apparatus.

10. The method of claim 1, wherein the drilling plan is designed by modifying a predetermined drilling plan on the basis of the pull-out.

11. The method of claim 1, wherein on the basis of the pull-out the drilling plan is designed for a round subsequent to the last-blasted round.

12. The method of claim 1, wherein on the basis of the pull-out the drilling plan is designed for any round subsequent to the round following the last-blasted round.

13. The method claim 1, wherein the positions of the drill holes in the predetermined coordinate system are defined using hole starting points, hole direction angles and drill hole lengths.

14. The method of claim 1, wherein the positions of the drill holes in the predetermined coordinate system are defined using starting points and ending points of the holes to be drilled.

15. The method of claim 1, wherein position of the starting points of the drill holes, and correspondingly, that of the ends of the drill holes in the predetermined coordinate system are determined for all holes to be drilled.

16. An arrangement for designing a drilling plan for excavating a rock cavern with a rock drilling apparatus comprising one or more drilling booms having a rock drilling unit attached to it, comprising:

a control unit for controlling drilling, including a computer for designing or modifying the drilling plan, the drilling plan having at least locations of drill holes in a predetermined coordinate system defined in advance of a round to be drilled;

means for determining in connection with hole drilling, a location of an end for at least some of the holes;

a memory for storing the determined locations of the hole ends; and means for determining the topography of the rock remaining after the round blast, a pull out of the blasted round being determined by the end location of the drill holes and topography of the rock remaining after a round blast and the drilling plan being designed or modified by the determined pull-out.

17. An arrangement according to claim 16, wherein the means for determining the topography of rock remaining after a round blast include a measuring device for measuring the profile of remaining rock.

18. An arrangement according to claim 16, wherein the means for determining the topography of rock remaining after a round blast comprise a measuring device for measuring the starting point of at least part of the drill holes for the next round on the surface of the rock and for calculating the approximate of the rock surface profile on the basis of the measured starting points.

19. An arrangement according to claim 18, wherein the measuring device is part of the control system of the rock drilling apparatus.

20. An arrangement according to claim 18, wherein the measuring device is separate from the control system.

* * * * *